US008997538B2

(12) United States Patent
Tobias et al.

(10) Patent No.: US 8,997,538 B2
(45) Date of Patent: Apr. 7, 2015

(54) MAGNETICALLY REPELLING LOCK ASSEMBLY

(75) Inventors: Marc Tobias, Sioux Falls, SD (US); Effi Ben-Aharon, Hod HaSharon (IL); Tobias Bluzmanis, Doral, FL (US)

(73) Assignee: Mul-T-Lock Technologies Ltd., Yavne (IL)

( * ) Notice: Subject to any disclaimer, the term of this patent is extended or adjusted under 35 U.S.C. 154(b) by 0 days.

(21) Appl. No.: 14/117,853

(22) PCT Filed: Jun. 15, 2012

(86) PCT No.: PCT/US2012/042553

§ 371 (c)(1),
(2), (4) Date: Apr. 8, 2014

(87) PCT Pub. No.: WO2012/177493

PCT Pub. Date: Dec. 27, 2012

(65) Prior Publication Data

US 2014/0283567 A1 Sep. 25, 2014

(30) Foreign Application Priority Data

Jun. 19, 2011 (IL) ..... 213650

(51) Int. Cl.
*E05B 47/00* (2006.01)
*E05B 27/00* (2006.01)

(52) U.S. Cl.
CPC ..... *E05B 27/0057* (2013.01); *E05B 47/0044* (2013.01); *E05B 27/0021* (2013.01); *E05B 27/0078* (2013.01)

(58) Field of Classification Search
USPC ..... 70/276, 413, 356–358
See application file for complete search history.

(56) References Cited

U.S. PATENT DOCUMENTS

| | | | | |
|---|---|---|---|---|
| 3,633,393 | A * | 1/1972 | Hisatsune | 70/276 |
| 3,654,782 | A * | 4/1972 | Heimann | 70/276 |
| 3,935,720 | A | 2/1976 | Boving | |
| 4,084,416 | A * | 4/1978 | Prunbauer | 70/276 |
| 4,220,021 | A * | 9/1980 | Burger et al. | 70/276 |
| 4,333,327 | A | 6/1982 | Wake | |
| 4,380,162 | A * | 4/1983 | Woolfson | 70/276 |
| 2010/0024499 | A1 | 2/2010 | Xu | |
| 2010/0050715 | A1 * | 3/2010 | Hu et al. | 70/356 |

FOREIGN PATENT DOCUMENTS

| | | |
|---|---|---|
| EP | 2090726 | 8/2009 |
| GB | 1151202 | 5/1969 |
| GB | 1406579 | 9/1995 |
| WO | 2009/147677 | 12/2009 |

OTHER PUBLICATIONS

PCT Written Opinion PCT/US2012/042553, Nov. 13, 2012.

* cited by examiner

*Primary Examiner* — Suzanne Barrett
(74) *Attorney, Agent, or Firm* — Dekel Patent Ltd.; David Klein

(57) ABSTRACT

A lock assembly (10) including a plug (12) having a keyway (14) for inserting therein a key (16), and a movable element (18) movingly disposed in the plug (12), the movable element (18) being divided into at least two separate magnetic portions (20, 22) arranged to move relative to one another and having identical magnetic polarity, wherein the magnetic portions (20, 22) are sufficiently near one another such that one of the magnetic portions (20, 22) applies a magnetic repelling force on the other magnetic portion (20, 22).

9 Claims, 1 Drawing Sheet

MAGNETICALLY REPELLING LOCK ASSEMBLY

FIELD OF THE INVENTION

The present invention relates to locking apparatus generally and more particularly to a lock assembly with magnetically repelling elements, which make picking the lock more difficult.

BACKGROUND OF THE INVENTION

There are many magnetically actuated locks in the prior art. Such locks typically mimic conventional key operated tumbler locks in their design and operation, wherein magnetic elements in a key cooperate with corresponding magnetic pins or other elements in the lock body to bring the magnetic pins to a shear line. Such magnetic locks suffer from similar drawbacks as conventional key operated tumbler locks; i.e., they may be picked by burglars using only moderately sophisticated techniques, and they may be disabled by any object inserted into the key slot.

A further consideration is the nature of the repulsive forces between magnets. Tumblers or latches which are operated by spring force may easily be designed to travel in a desired direction without binding or sticking. When considering magnetically operated latches and tumblers, it must be noted that magnets of similar confronting polarities not only impart a repelling force to each other, but also tend to rotate so that the opposite poles may move into confrontation. Prior art magnetic lock designs which failed to allow for this characteristic behavior have suffered from high failure rates due to magnetic actuators which pivot and bind in the mechanism.

SUMMARY OF THE INVENTION

The present invention seeks to provide a novel lock assembly with magnetically repelling elements, which make picking the lock more difficult, but which does not suffer from the abovementioned drawbacks of the prior art, as is described more in detail hereinbelow.

There is thus provided in accordance with an embodiment of the present invention a lock assembly including a plug having a keyway for inserting therein a key, and a movable element movingly disposed in the plug, the movable element being divided into at least two separate magnetic portions arranged to move relative to one another and having identical magnetic polarity, wherein the magnetic portions are sufficiently near one another such that one of the magnetic portions applies a magnetic repelling force on the other magnetic portion.

Non-limiting embodiments of the invention include one or more of the following features:

The movable element is adapted to be moved by a key inserted in the keyway to an operative position that permits operation of a locking element (which may or may not be part of the invention), and wherein the magnetic repelling force acts to move at least one of the magnetic portions away from the operative position. The locking element may be disposed in the plug (e.g., a sidebar) or may be external to the plug.

The movable element is formed with one or more notches, which are adapted to be aligned in a predetermined alignment in the operative position.

The movable element is movingly disposed in a bore formed in the plug, and the magnetic portions are arranged to move relative to one another in the bore.

The movable element includes a non-circular portion arranged to move in a correspondingly non-circular bore formed in the plug.

The movable element includes a protrusion that is adapted to be slidingly received in a groove formed in the key, such that movement of the protrusion in the groove moves the movable element to the operative position.

BRIEF DESCRIPTION OF THE DRAWINGS

The present invention will be understood and appreciated more fully from the following detailed description, taken in conjunction with the drawings in which.

DETAILED DESCRIPTION OF EMBODIMENTS

Figure 1:
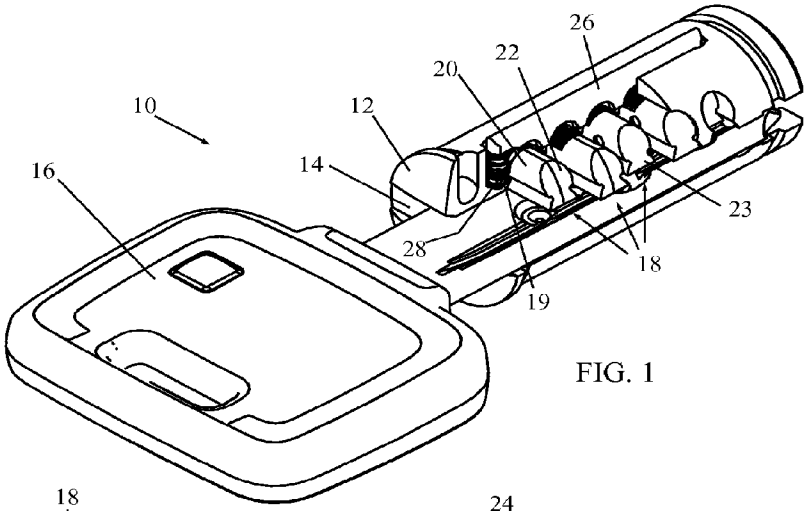
FIG. 1 is a simplified perspective illustration of a lock assembly, constructed and operative in accordance with an embodiment of the present invention, with a key inserted into a plug that has movable elements with magnetic portions.
Figure 2:
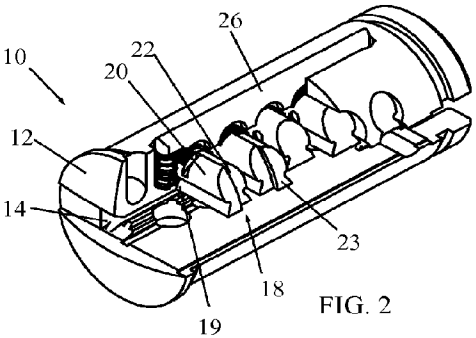
FIG. 2 is a simplified perspective illustration of the plug of the lock assembly.

Reference is now made to FIGS. 1 and 2, which illustrates a lock assembly 10, constructed and operative in accordance with a non-limiting embodiment of the present invention.

Lock assembly 10 includes a plug 12 having a keyway 14 for inserting therein a key 16. In the illustrated embodiment, key 16 has key cuts for interfacing with telescoping pins (not shown) disposed in the plug 12. However, the invention is not limited to such a key and can be carried out with any another key with key cuts formed on any surface of the key.

One or more movable elements 18 are movingly disposed in plug 12. Some or all of these movable elements 18 are divided into at least two separate portions 20 and 22, such as being split down the entire length thereof (as seen clearly in FIGS. 3A and 4A, wherein the element 18 is divided into two; alternatively, the element 18 may be divided into more than two portions). Each of the divided portions 20 and 22 is provided with a magnet 24, and adjacent portions 20 and 22 have identical magnetic polarities (either both north or both south). Thus, the movable element 18 is divided into at least two separate magnetic portions 20 and 22 arranged to move relative to one another and having identical magnetic polarity. Magnetic portions 20 and 22 are sufficiently near one another such that one of the magnetic portions applies a magnetic repelling force on the other magnetic portion due to the identical magnetic polarity.

Movable element 18 is movingly disposed in a bore 19 formed in plug 12, and the magnetic portions 20 and 22 are arranged to move relative to one another in bore 19. Movable element 18 includes a non-circular portion 23 arranged to move in the correspondingly non-circular bore 19 formed in plug 12.

Figure 4A:
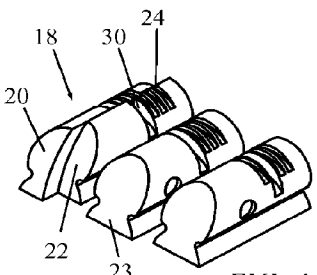
FIGS. 4A and 4B are simplified perspective illustrations of the movable elements of the plug, corresponding to FIGS. 3A and 3B, respectively before and after being aligned into the operative position.
Figure 3A:
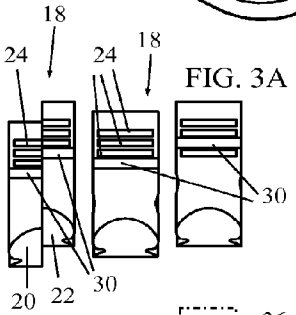
FIGS. 3A and 3B are simplified top-view illustrations of the movable elements of the plug, wherein one of the movable elements is divided into two portions, respectively before and after being aligned (by insertion of the key of FIG. 1, not shown here) into an operative position that permits operation of a locking element (shown in FIG. 1)

As seen in FIGS. 3A and 4A, some of the movable elements 18 may be left undivided, wherein the magnetic strength of neighboring, undivided movable elements 18 is sufficient that they apply a magnetic repelling force on each other.

Figure 4B:
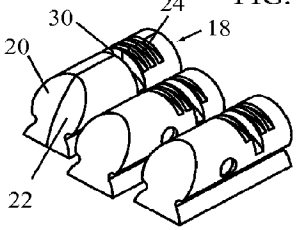
Figure 3B:
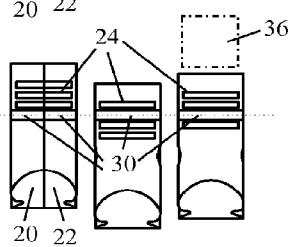

The movable elements 18 are arranged to be aligned by insertion of the key 16 to an operative position that permits operation of a locking element 26. In the illustrated embodiment of FIGS. 1 and 2, locking element 26 is a sidebar disposed in plug 12. The sidebar may be spring-loaded by one or more biasing devices 28 (e.g., coil springs). Each of the movable elements 18 is formed with one or more notches 30, which are adapted to be aligned in a predetermined alignment in the operative position. In the example of the sidebar, this means that in the operative position (shown in FIGS. 3B and 4B), when key 16 is fully inserted in keyway 14, the notches 30 are aligned so that the sidebar can move into the notches 30 and permit rotation of plug 12 by key 16.

However, when key 16 is not inserted in keyway 14, or alternatively, when a picking tool is inserted in keyway 14, the magnetic repelling force between adjacent magnetic portions 20 and 22 acts to move the magnetic portions 20 and 22 away from the operative position (as seen in FIGS. 3A and 4A). Thus, the magnetic feature of the invention acts against picking attempts on the lock.

Figure 5:
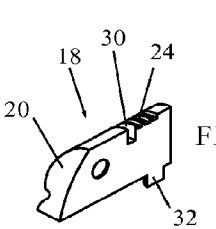
FIG. 5 is a simplified perspective illustration of one of the movable elements of the plug of the lock assembly, showing a protrusion that protrudes from the movable element.
Figure 6:
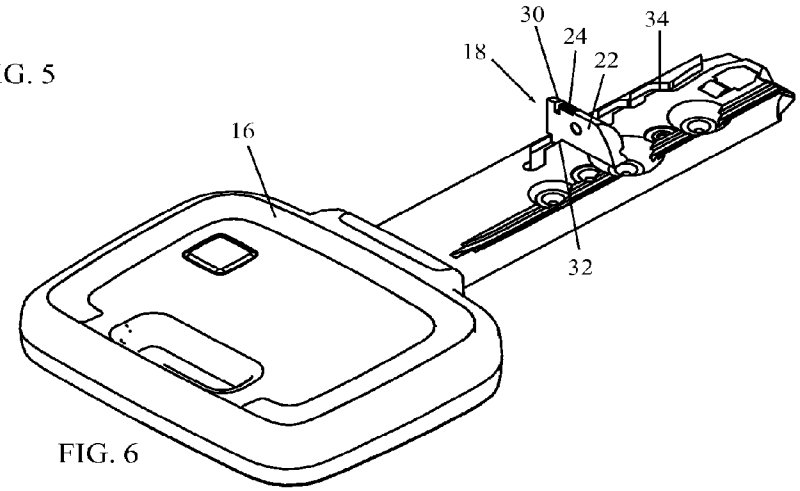
FIG. 6 is a simplified pictorial illustration of the protrusion of the movable element sliding in a groove formed in the key, in order to reach the operative position, in accordance with an embodiment of the present invention.

Reference is now made to FIGS. 5 and 6. Movable element 18 includes a protrusion 32 that is adapted to be slidingly received in a groove 34 (FIG. 6) formed in key 16. Movement of protrusion 32 in groove 34 moves the movable element 18 to the operative position described above.

As mentioned above, the locking element 26 may be disposed in plug 12, as in the case of the sidebar. Alternatively, as shown in broken lines in FIG. 3B, the locking element 26 may be external to plug 12, such as a body or driver pin 36, disposed in the body of the cylinder lock (not shown) in which plug 12 can rotate. The driver pin 36 abuts against the end of the movable element 18.

The scope of the present invention includes both combinations and subcombinations of the features described hereinabove as well as modifications and variations thereof which would occur to a person of skill in the art upon reading the foregoing description and which are not in the prior art.

What is claimed is:

1. A lock assembly comprising:

a plug having a keyway for inserting therein a key; and a movable element movingly disposed in said plug, said movable element being divided into at least two separate magnetic portions arranged to move relative to one another and having identical magnetic polarity, wherein said magnetic portions are sufficiently near one another such that one of said magnetic portions applies a magnetic repelling force on the other magnetic portion, and wherein said movable element is movable between an inoperative position, in which movement of said plug is prevented, and an operative position, in which movement of said plug is not prevented, and wherein at least one magnetic portion of said movable element is moved away from its operative position by the magnetic repelling force, and wherein said movable element comprises a protrusion that is adapted to be slidingly received in a groove formed in said key, such that movement of said protrusion in said groove moves said movable element to said operative position.

2. The lock assembly according to claim 1, wherein said movable element is adapted to be moved by a key inserted in said keyway to an operative position that permits operation of a locking element, and wherein said magnetic repelling force acts to move at least one of said magnetic portions away from said operative position.

3. The lock assembly according to claim 1, further comprising a locking element movable relative to said plug, and wherein said movable element is adapted to be moved by a key inserted in said keyway to an operative position that permits operation of said locking element, and wherein said magnetic repelling force acts to move at least one of said magnetic portions away from said operative position.

4. The lock assembly according to claim 3, wherein said locking element is disposed in said plug.

5. The lock assembly according to claim 3, wherein said locking element is external to said plug.

6. The lock assembly according to claim 3, wherein said locking element comprises a sidebar.

7. The lock assembly according to claim 2, wherein said movable element is formed with a notch, which is adapted to be aligned in a predetermined alignment in said operative position.

8. The lock assembly according to claim 1, wherein said movable element is movingly disposed in a bore formed in said plug, and said magnetic portions are arranged to move relative to one another in said bore.

9. The lock assembly according to claim 1, wherein said movable element comprises a non-circular portion arranged to move in a correspondingly non-circular bore formed in said plug.

* * * * *